United States Patent [19]

Raasch

[11] 4,058,966

[45] Nov. 22, 1977

[54] DEVICE FOR PROTECTING TANGENTIAL DRIVES OF A TEXTILE MACHINE

[75] Inventor: Hans Raasch, Monchengladbach, Germany

[73] Assignee: W. Schlafhorst & Co., Monchengladbach, Germany

[21] Appl. No.: 712,196

[22] Filed: Aug. 6, 1976

[30] Foreign Application Priority Data

Aug. 7, 1975 Germany ..... 2535254

[51] Int. Cl.[2] ..... D01H 13/20; D01H 13/14

[52] U.S. Cl. ..... 57/78; 57/104

[58] Field of Search ..... 57/22, 34 R, 58.89, 57/78, 80, 81, 93, 156, 104, 88, 58.95; 242/37, 36

[56] References Cited

U.S. PATENT DOCUMENTS

| | | | |
|---|---|---|---|
| 2,718,747 | 9/1955 | Honig | 57/104 X |
| 3,099,829 | 7/1963 | Namenyi-Katz | 57/81 X |
| 3,114,233 | 12/1963 | Guri | 57/81 |
| 3,375,649 | 4/1968 | Bures et al. | 57/81 X |
| 3,842,579 | 10/1974 | Bartling | 57/58.89 X |
| 3,908,347 | 9/1975 | Vignon | 57/81 X |
| 3,911,656 | 10/1975 | Vignon | 57/81 X |

*Primary Examiner*—Donald Watkins
*Attorney, Agent, or Firm*—Herbert L. Lerner

[57] ABSTRACT

Method of protecting against destruction of or damage to tangential strands and rotatable members of a textile machine having a plurality of individual work stations and operating with traveling threads, which includes monitoring with a monitoring device traveling along the textile machine the rotation of the rotatable members of the textile machine driven by the tangential strands thereof, determining non-rotation of at least one of the rotatable members or decrease of speed of rotation thereof below a given value at a given work station of the textile machine and accordingly disengaging the respective tangential strand at the given work station from frictional engagement and securing it against renewed frictional engagement; and device for carrying out the foregoing method.

8 Claims, 3 Drawing Figures

DEVICE FOR PROTECTING TANGENTIAL DRIVES OF A TEXTILE MACHINE

The invention relates to a method and device for protecting against destruction of or damage to tangential drives, especially tangential strands such as tangential belts and tangential lines, strings or cords and rotatable members of a textile machine formed of individual work stations and operating with traveling threads.

In rotor spinning frames or machines, for example, the rotors and the fiber-loosening or break-up cylinders are frequently driven by tangential belts. It can happen that rotors or fiber-loosening cylinders may become blocked or stall during operation. The cause thereof is usually fiber pile-up. In the event of blockage or stall, the tangential belt slides over the drive whirl of the rotor or the fiber loosening cylinder. This causes heavy heating, so that major damage can be sustained by the respective spinning frame. The greatest danger, however, is that the tangential belt may become damaged so that all spinning stations of the spinning frame or machine must be shut down in order to replace the tangential belt. The danger of requiring extended shutdown periods is especially great if the spinning frame has a device for automatically repairing thread breaks. In that case, a very large number of spinning frames or machines is assigned to operating or servicing personnel for monitoring and it can happen that a blockage or stall may not be noted for a relatively long period of time.

It is accordingly an object of the invention to provide a method and device for protecting the tangential drives against destruction or damage which avoids the foregoing disadvantages of heretofore known spinning frames or machines.

With the foregoing and other objects in view, there is provided, in accordance with the invention, a method of protecting against destruction of or damage to tangential strands, such as belts, lines, strings or cords, and rotatable members of a textile machine having a plurality of individual work stations and operating with traveling threads, which comprises monitoring with a monitoring device traveling along the textile machine the rotation of the rotatable members of the textile machine driven by the tangential strands thereof, determining non-rotation of at least one of the rotatable members or decrease of speed of rotation thereof below a given value at a given work station of the textile machine, and accordingly disengaging the respective tangential strand at the given work station from frictional engagement and securing it against renewed frictional engagement.

The monitoring device may be combined with the device which automatically repairs thread breaks at the individual work stations. In a rotor spinning frame or machine, for example, no additional thread is spun upon blockage of the fiber-loosening cylinder or the rotor, so that this work station signals a thread break. Consequently, in accordance with another feature of the invention, when the textile machine has means for signaling a thread break at the respective work stations, the method of the invention comprises monitoring the rotation of the rotatable members with the monitoring device only at those work stations signaling a thread break. If there is no rotation, no attempt need then be made to repair the thread break. Consequently, in the event of a thread-break indication, the common traveling device initially checks or inspects for the rotation.

In accordance with the device for carrying out the method of the invention, there are provided monitoring means capable of traveling along the textile machine for monitoring rotation of the rotatable members driven by the tangential strands, the monitoring means comprising at least one running signal receiver or one trouble signal receiver, and at least one running signal transmitter or one trouble signal transmitter associated with the rotatable members at the respective work stations being monitored with respect to the rotation thereof.

Running signal transmitters and running signal receivers may have contactless operation, for example, may operate inductively, capacitively, photoelectrically or by other means. It is particularly advantageous and operationally reliable if a reflection light barrier, such as a photoelectric device, is used as the signal transmitter and signal receiver. In this regard, a reflector is fastened to the rotating member, and a speed-proportional signal can be produced in the signal receiver.

In accordance with a further feature of the invention, at every work station of the textile machine, coupling means can be provided for removing the tangential belt or the tangential line, string or cord from the rotating members associated therewith and for securing them simultaneously against renewed contact. The coupling means, in accordance with the invention, are actuatable manually or automatically or are actuatable selectively manually and automatically.

In accordance with an additional feature of the invention, means for actuating the coupling means and controllable by the running signal receiver or trouble signal receiver are associated with the traveling monitoring means.

The trouble ascertained by the running signal receiver or trouble signal receiver is advantageously reported to the supervisor responsible for the respective textile machine, as well as to any automatic monitoring devices that may be provided. The supervisor is supposed to correct the operational disturbance or trouble as rapidly as possible, and the monitoring devices should not be restored to operation any more at the troubled work station until the trouble is corrected. In accordance, therefore, with a concomitant feature of the invention a trouble indicating device controlled by the traveling monitoring means is associated with each of the work stations of the textile machine.

Advantages derived from the invention are especially that, simultaneously with the protection of the tangential drives against damage or destruction, secondary damage is also avoided. In particular, the invention practically prevents the sudden failure of a tangential belt or a tangential line, string or cord resulting from increased wear, as well as any secondary or consequent damage resulting from shutdown of the entire textile machine.

Other features which are considered as characteristic for the invention are set forth in the appended claims.

Although the invention is illustrated and described herein as embodied in a method and device for protecting tangential drives of a textile machine, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which.

Figure 1:
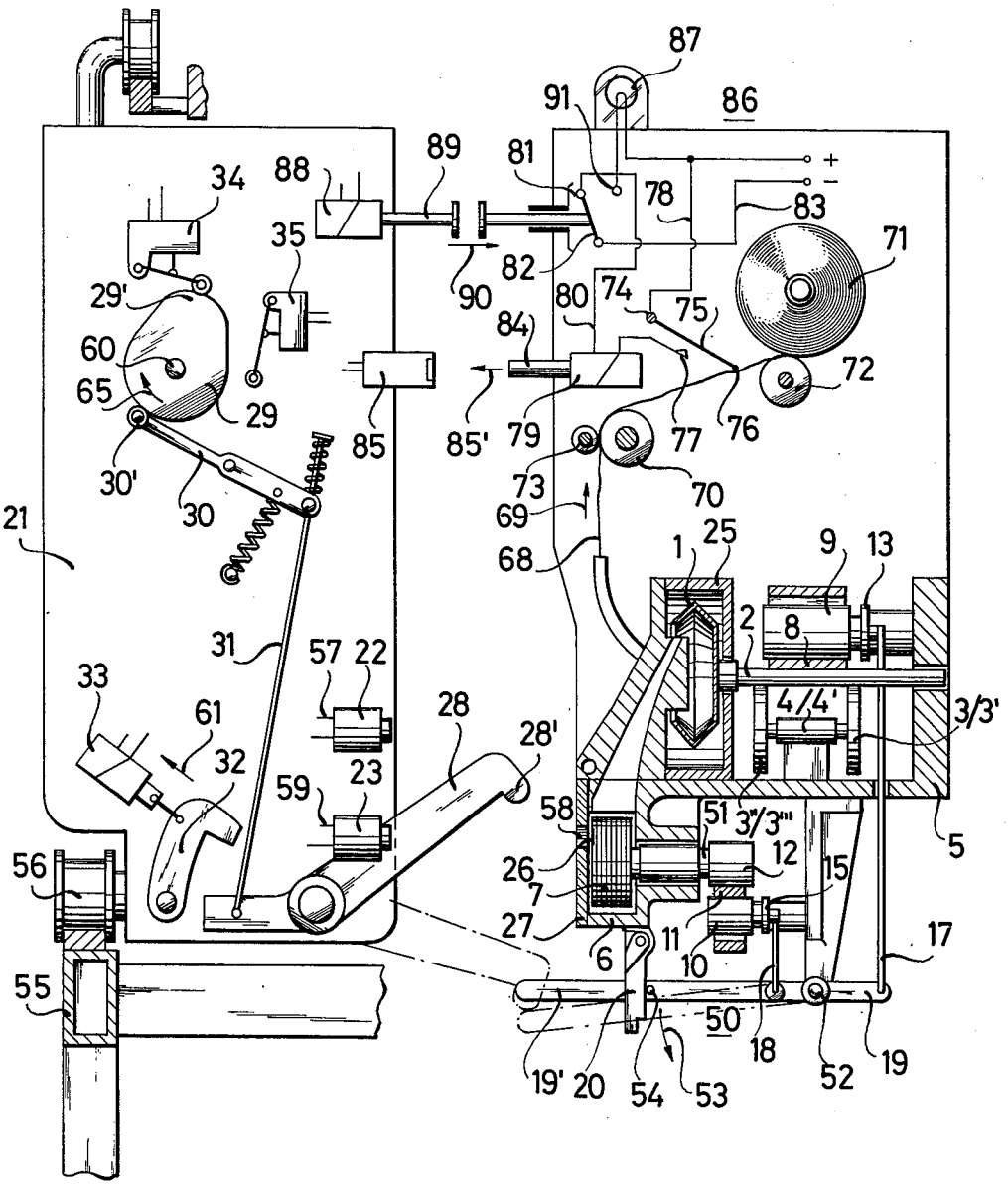
FIG. 1 is a fragmentary cross-sectional, partly diagrammatic view of a work station 50 of a rotor spinning frame and a fragmentary diagrammatic view of a monitoring device 21 which is capable of traveling past the rotor spinning frame.

Referring now to the drawing and first, particularly, to FIG. 1 thereof, there is shown a work station 50 of a rotor spinning frame or spinning machine having a rotor 1 mounted on a rotor shaft 2 supported by two pairs of support rollers, 3, 3'', and 3', 3''', bearings 4, 4' of which are mounted in the frame 5 of the spinning machine. Housings 25 and 6 for the rotor 1 and a fiber-loosening or break-up cylinder 7, respectively, are also fastened to the machine frame 5.

The rotor 1 is driven by contact with the lower run of a tangential strand such as a belt 8. The contact is forcibly effected by a pressure roller 9. The fiber-loosening or break-up cylinder 7 is driven due to the pressure applied by a pressure roller 10 against the upper run of another tangential belt 11 against a whirl 12 connected by a shaft 51 to the loosening cylinder 7.

Figure 2:
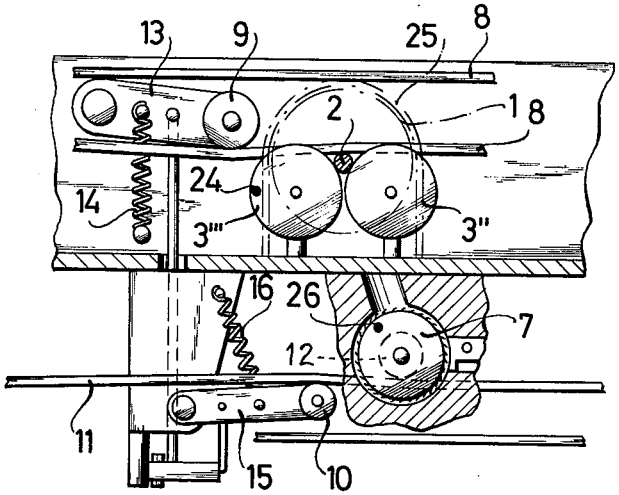
FIG. 2 is a fragmentary front elevational view partly in section and partly broken away, of the work station 50 as seen from the left hand side in FIG. 1 showing only some of the parts thereof located at the lower right-hand side of FIG. 1.

As can more readily be seen in FIG. 2, the pressure roller 9 is pressed against the tangential belt 8 by a lever 13 under the biasing action of a tension spring 14. It is further apparent therein that the pressure roller 10 presses the tangential belt 11 against the whirl 12 of the loosening cylinder 7 by means of a lever 15 under the biasing action of a tension spring 16. As shown in FIG. 1, the levers 13 and 15 are connected to a coupling lever 19 by respective tie rods 17 and 18. The coupling lever 19 is connected by an articulating joint 52 to the machine frame 5. If the long lever arm 19' of the coupling lever 19 is moved in the direction of the arrow 53, the pressure rollers 9 and 10 are lifted away from the respective tangential belts 8 and 11 by means of the tie rods 17 and 18, respectively, and the tangential belts 8 and 11 then occupy a position, in which they no longer engage the rotating members.

The tie rod 17 can advantageously be given such a length that the pressure roller 9 is lifted from the belt 8 first. If the lever arm 19' is swung so far in direction of the arrow 53 that only the pressure roller 9 is lifted from the respective belt 8, then only the rotor 1 stops rotating, whereas the fiber-loosening cylinder 7 continues to run. Such a construction is necessary, for example, to permit automatic thread joining in a spinning frame. If the lever arm 19' is swung farther in direction of the arrow 53, the pressure roller 10 is then also lifted away from the respective tangential belt 11. In this position, the coupling lever 19 is automatically secured by a latch 20 engaging with a pin 54 against unintentional return to the starting position. The tangential belts 8 and 10 are thereby also secured against renewed contact with the rotatable members.

The monitoring device 21 serves both for monitoring the rotation of the various rotatable members of the spinning frame and for simultaneously repairing thread breaks.

At the monitoring device 21, which can travel on the track 55 by means of the roller 56, reflection light barriers 22 and 23 are provided. The most common examples of such light barriers are photoelectric cells or similar devices. The reflection light barrier 22 is fastened so that the light beam therefrom, in a given position of the support roller 3, is reflected into the starting direction by a reflector 24 (FIG. 2) fastened on the support roller 3. It is apparent from FIG. 2 that this disposition of the reflector 24 is particularly advantageous because the ray path is outside the rotor housing 25. Every time the reflector 24 appears in the ray path of the reflection light barrier 22, a brief running signal appears at the output 57 thereof.

The reflection light barrier 23 is disposed so that the light beam therefrom strikes a reflector 26 which is fastened at the end fact of the fiber-loosening cylinder 7. The housing 6 has a cover 27 formed with an opening 58 to permit passage of the light beam therethrough.

Every time the reflector 26 appears in the ray path of the reflection light barrier 23, a brief running signal appears at the output 59 thereof.

The monitoring device 21 is additionally provided with an actuating lever 28 which is actuatable by a cam 29 acting through a cam lever 30 and a tension or tie rod 31. A latch 32, which is actuatable by an electromagnet 33, inhibits the motion of the actuating lever 28 as long as the electromagnet 33 is currentless. If the cam 29 rotates about the shaft 60, and the latch 32 limits the travel of the actuating lever 28, as shown in FIG. 1, the actuating lever 28 can press down the long lever arm 19' of the coupling lever 10 only far enough so that the pressure roller 9 is lifted away from the belt 8 and the rotor 1 stops. The fiber-loosening cylinder 7 thus continues to rotate. If the electrically energized electromagnet 33 pulls back the latch 32 in direction of the arrow 61, however, the projection or nosepiece 28' of the actuating lever 28 presses the long lever arm 19' of the coupling lever 19 down so far that the latch 20 snaps-in behind the pin 54. The pressure roller 10 is, thereby, also removed from the respective tangential belt 11, so that the fiber-loosening cylinder 7 also stops. A prerequisite therefor is that the cam portion 29' of the cam 29 must be situated in front of the follower roller 30' of the cam lever 30. The cam 29 can also actuate the switches 34 and 35, the function of which will be explained in the following paragraphs.

It can further be seen in FIG. 1 that a thread 68 is withdrawn in direction of the arrow 69 by means of a rotary draw-off cylinder 70 and is wound on a coil or bobbin driven by a thread guide roller 72. A pressure roller 73 presses the thread 68 against the draw-off or withdrawal cylinder 70. A thread sensor or feeler 75 pivoted at a contact 74 monitors the thread tension, an end 76 thereof resting on the thread. With slackening thread tension, the thread feeler 75 engages a contact 77, thereby closing a circuit extending from a positive terminal of a voltage source through a line 78, an electromagnet 79, a line 80, a contact 81 of a switch 82 and a line 83 to the negative terminal of the voltage source. The armature 84 of the electromagnet 79 is thereby displaced in direction of the arrow 85' and appears within the effective range of an initiator 85 which is fastened to the traveling monitoring device 21.

If the initiator 85 then detects the outwardly driven armature 84, as the monitoring device 21 travels past the work station 50, the initiator 85 initiates the stoping of the monitoring device 21 in front of the work station 50 as well as specific activity, in this case, the joining of the spun thread.

It may further be seen from FIG. 1 that a trouble indicating device 86 is associated with the work station 50. The indicating device 86 has an indicator lamp 87 and a switch 82. Since the monitoring device 21, at the beginning of the activity thereof, initially checks the rotor 1 and the fiber-loosening cylinder 7 are running undisturbed, an electromagnet 88 becomes energized immediately. if the operation of the aforementioned members is disturbed; the armature 89 of this electromagnet 88 is then shifted in direction of the arrow 90, and the switch 82 switches from the contact 81 to a contact 91. The indicator lamp 87 is thereby switched on, and the electromagnet 79 is switched off. As long as the switch 82 remains in the newly switched-over position, the electromagnet 79 can no longer be energized. During this time, the initiator 85 cannot respond and renewed activation of the monitoring device 21 is prevented until the trouble is corrected and the switch 82 is manually returned to the contact 81, at which the indicator lamp 87 is extinguished and the current path of the electromagnet 79 rendering the thread feeler 75 responsive is connected through. Further details of the electrical circuit are explained in the following paragraph.

Figure 3:
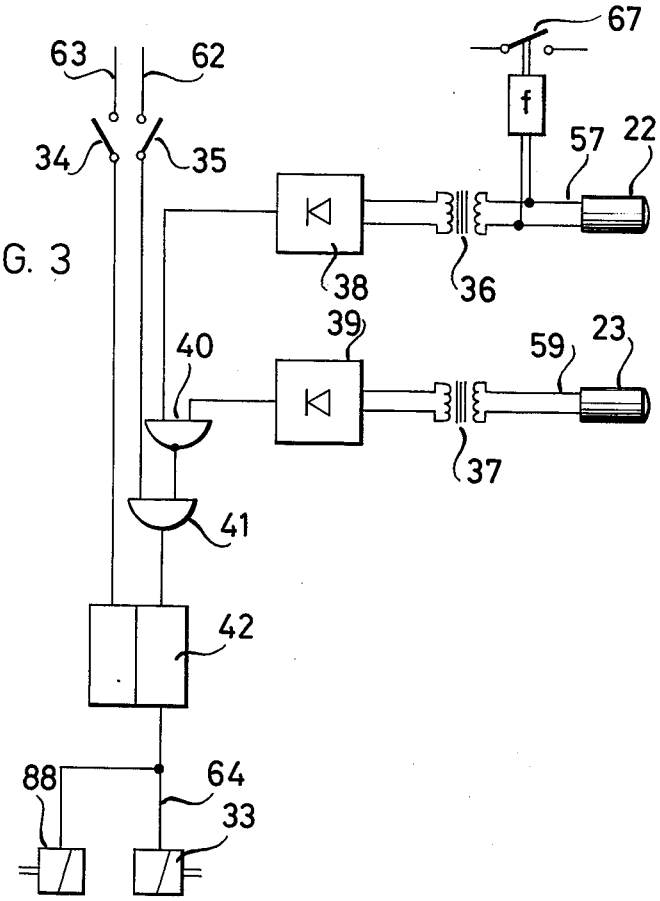
FIG. 3 is a circuit diagram of the monitoring device of the invention.

In FIG. 3, an embodiment of a circuit of the monitoring device 21 is shown. The output 57 of the reflection light barrier 22 is connected through a transformer 36 and a rectifier 38 to a first input of a NAND gate 40. The output 59 of the reflection light barrier 23 is connected through a transformer 37 and a rectifier 39 to the second input of the same NAND gate 40. The transformers 36 and 37 act to block voltages that do not have an a-c component. Voltage with a-c components appears at the outputs 57 and 59 only if the reflector of the corresponding light barriers 22, 23 appears periodically in the light ray path.

In the rectifiers 38 and 39, the secondary voltage of the respective transformers 36 and 37 is rectified, and the d-c voltage, that is passed on to the inputs of the NAND gate 40, is smoothed. At the output of the NAND gate 40, a 1-signal is always present if one or both reflection light barriers 22 and 23 does not deliver a voltage with an a-c component i.e., if the fiber-loosening dylinder 7 or the rotor 1 or both are stationary.

The output of the NAND gate 40 is connected to a first input of an AND gate 41. The second input of the AND gate 41 is connected to the switch 35, to which d-c voltage is applied through a line 62. The switch 35 is closed by the cam 29 only if the traveling monitoring device 21 has arrived in front of a work station 50 which has reported a thread break. If the AND condition is present at the gate 41, a storage device 42 is set through the output of the gate 41, and the electromagnets 33 and 88 are thereby energized through a line 64. After the electromagnet 33 has pulled back the latch 32 in direction of the arrow 61, due to further rotation of the cam 29 in direction of the arrow 65, the actuating lever 28 is lowered by means of the tension or pull rod 31 and the cam lever 30 so far that the latch 20 snaps-in behind the pin 54 of the coupling lever 19, both tangential belts 8 and 11 being lifted simultaneously from the rotating members associated therewith and are secured against renewed contact.

The storage device 42 remains set until the switch 34 is closed and a clearing signal reaches a second input of the storage device 42 from the line 63 through the closed switch 34. With the storage device 42 cleared, the electromagnets 33 and 88 are deenergized. The switch 34 is closed if the cam 29 has returned to the rest or neutral position thereof through further rotation in direction of the arrow 65.

The coupling lever 19 can only be unlatched manually. It is unlatched after the trouble has been corrected.

In the event of a thread break indication when the turbine 1 or the fiber-loosening cylinder 7 is not stationary, which is the normal case, the AND condition is, from the start, also not fulfilled at the AND gate 41 if the switch 35 is closed. Therefore, in the normal case, only the turbine 1 can be stopped by the actuating lever 28 temporarily and without latching, which is the condition for the initiation or introduction of an automatic thread-joining operation.

From the output 57 of the reflection light barrier 22, there is a connection to a frequency-controlled threshold switch 67. After the rotor 1 has been switched on again, the threshold switch 67 is closed at a predetermined rotor frequency which is below the operating frequency, and, thereby, the automatic thread-joining preocedure is initiated. The joining can be carried out particularly favorably and trouble-free in a given rotor speed range.

There are claimed:

1. Device for protecting against destruction of or damage to tangential strands and rotatable members of a textile machine having a plurality of individual work stations and operating with traveling threads, comprising monitoring means capable of traveling along the textile machine for successively monitoring rotation of the rotatable members driven by the tangential strands at each of the plurality of individual work stations, said monitoring means comprising at least one signal receiver, and at least one signal transmitter associated with the rotatable members at the respective work stations being monitored with respect to the rotation thereof, coupling means at each of the work stations for removing a faulty tangential strand from the rotatable members associated therewith and for simultaneously securing the tangential strand against renewed engagement with the rotatable members, and means associated with said traveling monitoring means for actuating said coupling means, said actuating means being controllable by said signal receiver.

2. Device according to claim 1 wherein said signal transmitter is a running signal transmitter, and said signal receiver is a running signal receiver.

3. Device according to claim 1 wherein said signal transmitter is a trouble signal transmitter, and said signal receiver is a trouble signal receiver.

4. Device according to claim 1 wherein said signal transmitter and said signal receiver are a reflection light barrier.

5. Device according to claim 1 wherein said coupling means are manually actuatable.

6. Device according to claim 1 wherein said coupling means are automatically actuatable.

7. Device according to claim 1 wherein said coupling means are selectively actuatable manually and automatically.

8. Device according to claim 1 including trouble-indicating means associated with each of the work stations and controlled by said traveling monitoring means.

* * * * *